US006102522A

United States Patent [19]

Hagiwara et al.

[11] Patent Number: 6,102,522

[45] Date of Patent: Aug. 15, 2000

[54] ELECTROSTATIC INK JET RECORDING APPARATUS AND METHOD OF PRODUCING THE SAME

[75] Inventors: Yoshihiro Hagiwara; Junichi Suetsugu; Tadashi Mizoguchi; Hitoshi Minemoto; Hitoshi Takemoto; Kazuo Shima; Toru Yakushiji, all of Niigata, Japan

[73] Assignee: NEC Corporation, Tokyo, Japan

[21] Appl. No.: 08/972,600

[22] Filed: Nov. 18, 1997

[30] Foreign Application Priority Data

Nov. 19, 1996 [JP] Japan ..... 8-308082

[51] Int. Cl.[7] ..... B41J 2/06

[52] U.S. Cl. ..... 347/55

[58] Field of Search ..... 347/55, 140, 120, 347/123, 154, 103, 141, 71, 68, 69; 399/271, 290, 292, 293, 294, 295; 29/890.1; 216/4; 430/311

[56] References Cited

U.S. PATENT DOCUMENTS 5,828,393 10/1998 Hotomi ..... 347/71

FOREIGN PATENT DOCUMENTS

| | | | |
|---|---|---|---|
| 0703080 | 3/1996 | European Pat. Off. | 347/55 |
| 6-31923 | 2/1994 | Japan . | |
| 7-120252 | 5/1995 | Japan . | |
| 7-276649 | 10/1995 | Japan . | |
| 8-309993 | 11/1996 | Japan . | |
| 9-11474 | 1/1997 | Japan . | |
| 9-57979 | 3/1997 | Japan . | |
| 93/11866 | 6/1993 | WIPO . | |

*Primary Examiner*—John Barlow
*Assistant Examiner*—Raquel Yvette Gordon
*Attorney, Agent, or Firm*—Ostrolenk, Faber, Gerb & Soffen, LLP

[57] ABSTRACT

In an electrostatic ink jet recording apparatus for ejecting toner contained in an insulative solvent with an electrostatic force, a record head includes record electrodes formed on a substrate by vapor deposition or application. The record electrodes are physically and electrically separated from each other by grooves each having at least two widths and at least two depths along their respective lengths. The record head has high quality and great mechanical strength and can be produced stably with high accuracy.

20 Claims, 6 Drawing Sheets

ELECTROSTATIC INK JET RECORDING APPARATUS AND METHOD OF PRODUCING THE SAME

BACKGROUND OF THE INVENTION

The present invention relates to an electrostatic ink jet recording apparatus and, more particularly, to a record head for an electrostatic ink jet recording apparatus of the type depositing toner particles on a recording medium.

A non-impact recording system is attracting increasing attention because it produces only negligible noise during operation. For example, an ink jet recording scheme is capable of recording data directly on a recording medium at a high speed with a simple configuration. The method of electrostatic ink jet recording is one of several ink jet recording methods proposed in the past and uses ink consisting of a carrier liquid and toner particles dispersed therein. The electrostatic ink jet recording method selectively applies a voltage between needle-like record electrodes and an electrode positioned at the rear of a recording medium. An electrostatic force derived from the above voltage causes the toner of the ink to fly toward the recording medium.

Various methods have been proposed for the production of the record head for practicing the electrostatic ink jet recording method. For example, a metal film is formed on a ceramic, silicon or similar wafer by sputtering and then cut by dicing or similar cutting scheme in order to form grooves. This allows ink passageways and independent record electrodes to be formed at the same time and enhances accurate machining, quantity production on a wafer, and stable quantity. Japanese Patent Laid-Open Publication No. 7-276649, for example, divides a depthwise range to be cut into a zone B including an ejection port, a zone A above the zone B, and a zone C below the zone A. In the event that dicing is used to form the ejection port surface and determine the passageway length, a particular feed rate is assigned to each of the three zones A, B and C in order to improve quality and yield.

However, the conventional method of producing a record head has the following problems left unsolved.

(1) It is required in the record head that each groove be provided with a particular configuration at an end there of adjoining an ejection head and at the opposite end there as adjoining a connecting portion. It has been customary with the record head to use a groove as an ink passageway, to use a wall between nearby grooves as an ejecting portion, and to use the metal film on the top of the wall as a record electrode. Because the ejection point should be as narrow and sharp as possible, the above wall should preferably be about 15 $\mu$m wide or less. The record electrode on the top of the wall must be connected to an outside electrode at the connecting portion opposite to the ejecting portion. Generally, such record electrodes arranged at a fine pitch are connected to outside circuitry by bonding or similar technology. In this sense, the 15 $\mu$m wide walls or electrodes are excessively narrow.

(2) The passageways are mechanically weak for the following reason. Each passageway should preferably be as great in volume as possible, and in addition each wall (ejection point) between nearby passageways should preferably be as narrow as possible. Therefore, it is necessary for the walls to be provided with a high aspect ratio. However, when the grooves each having a preselected width and a preselected depth are formed, they are mechanically extremely weak and reduce the yield of quantity production.

Technologies relating to the present invention are also disclosed in, e.g., Japanese Patent Laid-Open Publication Nos. 8-309993, 7-276649 and WO 93/11866.

SUMMARY OF THE INVENTION

It is therefore an object of the present invention to provide a record head for an electrostatic ink jet recording apparatus of the type for ejecting only toner particles contained in ink by a static electric field, and which is capable of enhancing quality and mechanical strength and ensuring stable and accurate production, and a method of producing the same.

In accordance with the present invention, in a record head for an electrostatic ink jet recording apparatus for ejecting toner contained in an insulative solvent with an electrostatic force, record electrodes formed on a substrate by vapor deposition or application are physically and electrically separated from each other by grooves each having at least two different widths and at least two different depths along its length.

Also, in accordance with the present invention, in a method of producing a record head for an electrostatic ink jet recording apparatus for ejecting toner contained in an insulative solvent with an electrostatic force, the record head including record electrodes formed on a substrate by vapor deposition or application and physically and electrically separated from each other by grooves each having at least two different widths and at least two different depths along its length, the grooves are formed by at least two rotary cutting edges each having a particular width.

BRIEF DESCRIPTION OF THE DRAWINGS

The above and other objects, features and advantages of the present invention will become apparent from the following detailed description taken with the accompanying drawings, in which.

DESCRIPTION OF THE PREFERRED EMBODIMENT

Figure 1:
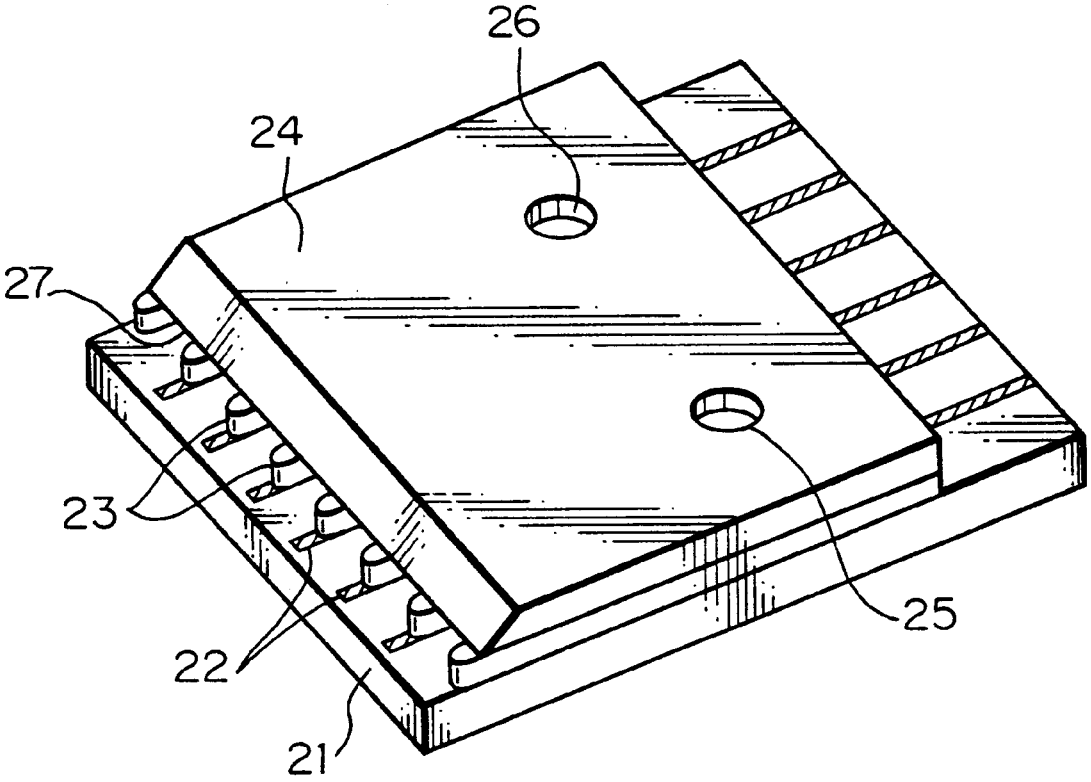
Fig. 1 PRIOR ART
FIG. 1 is a perspective view showing the appearance of a conventional record head for an electrostatic ink jet recording apparatus.
Figure 2A:
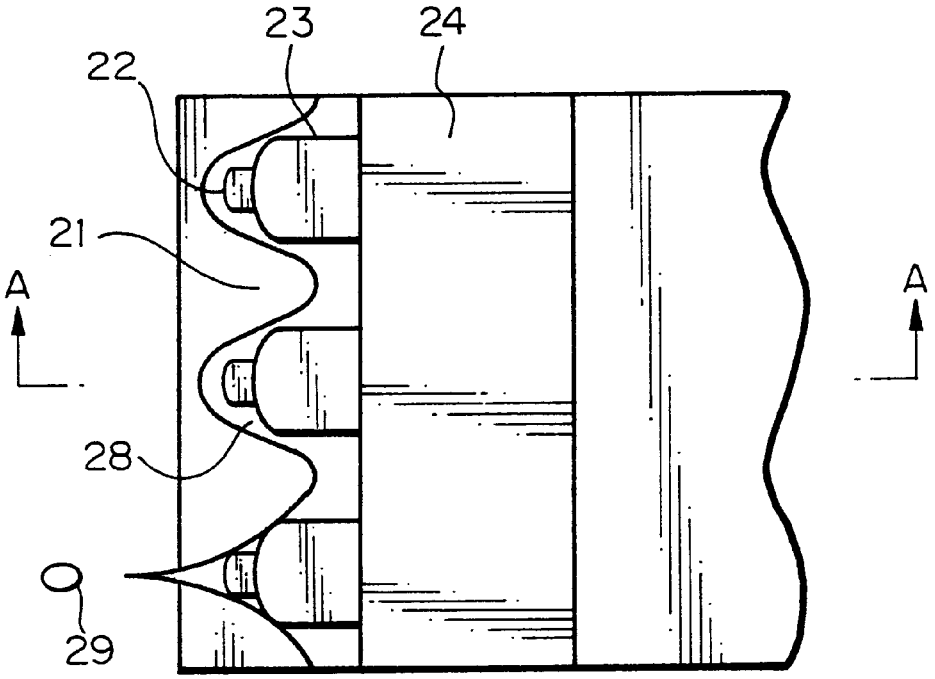
Fig. 2A PRIOR ART
FIG. 2A is a plan view of the record head shown in FIG. 1.
Figure 2B:
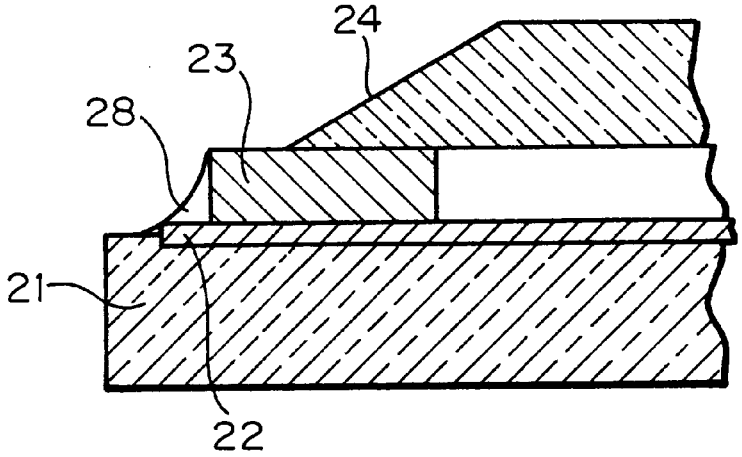
Fig. 2B PRIOR ART
FIG. 2B is a section along line A—A of FIG. 2A.

To better understand the present invention, brief reference will be made to a conventional record head included in an ink jet recording apparatus, shown in FIGS. 1, 2A and 2B. The record head to be described is taught in Japanese Patent Application No. 7-120252 mentioned earlier. As shown, the head includes a flat substrate 21 formed of an insulating material. A plurality of record electrodes 22 are formed o n the substrate 21 at intervals implementing a desired resolution. To form the record electrodes 22, the entire surface of the substrate 21 is covered with Cu, Ni or similar conductor by sputtering, exposed via a patterned mask, and then developed. The record electrodes 22 are independently from each other connected to a driver, not shown, at one end thereof. At the time of recording, the driver selectively applies high voltage pulses to the record electrodes 22. The surface of the substrate 21 formed with the record electrodes 22 is coated with an insulative coating material by spin coating, so that the electrodes 22 are insulated from ink.

Meniscus forming members 23 are each positioned on the respective record electrode 22. Specifically, the substrate 21 formed with the record electrodes 22 is covered with insulating photoresist by lamination or spin coating, exposed via a mask formed with a pattern representative of the meniscus forming members 23, and then developed so as to form the members 23. A cover 24 is mounted on the meniscus forming members 23, but set back from the front ends of the members 23 in the direction of ink ejection. The cover 24 is formed of an insulating material and formed with an ink inlet 25 and an ink outlet 26 beforehand. The substrate 21, cover 24 and meniscus forming members 23 form fine slit-like ejection ports 27. Ink fed from the ink inlet 25 is guided by the ejection ports 27 to the front ends of the meniscus forming members 23 protruding from the ejection ports 27. As a result, ink meniscuses are formed at the front ends of the meniscus forming member 23.

While various approaches have been proposed for the production of the above head, they have the problems (1) and (2) discussed earlier.

Figure 3:
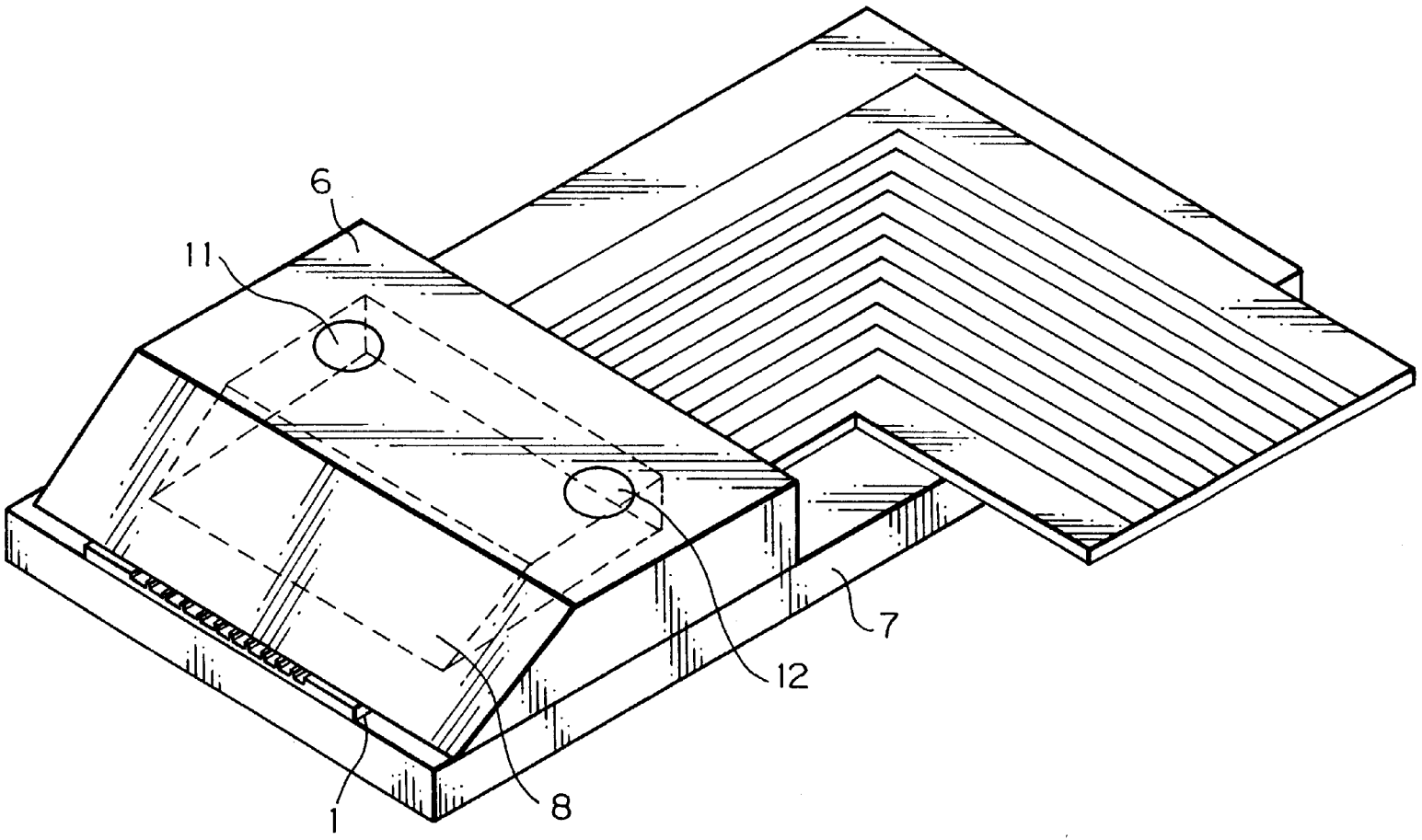
FIG. 3 is a perspective view showing a record head for an electrostatic ink jet recording apparatus and embodying the present invention.
Figure 4:
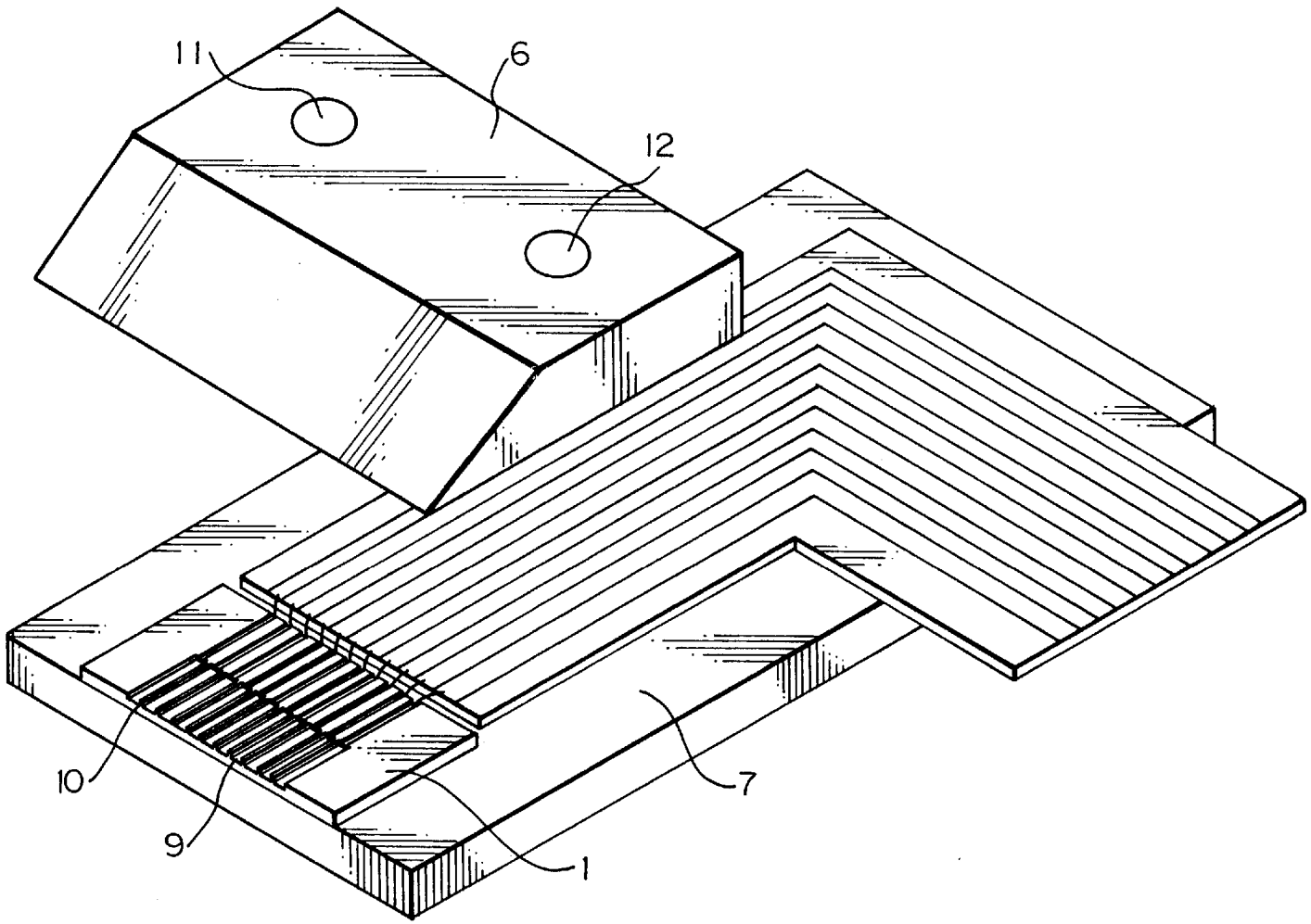
FIG. 4 shows the internal configuration of the embodiment of FIG. 3 by shifting an upper cover upward.
Figure 5:
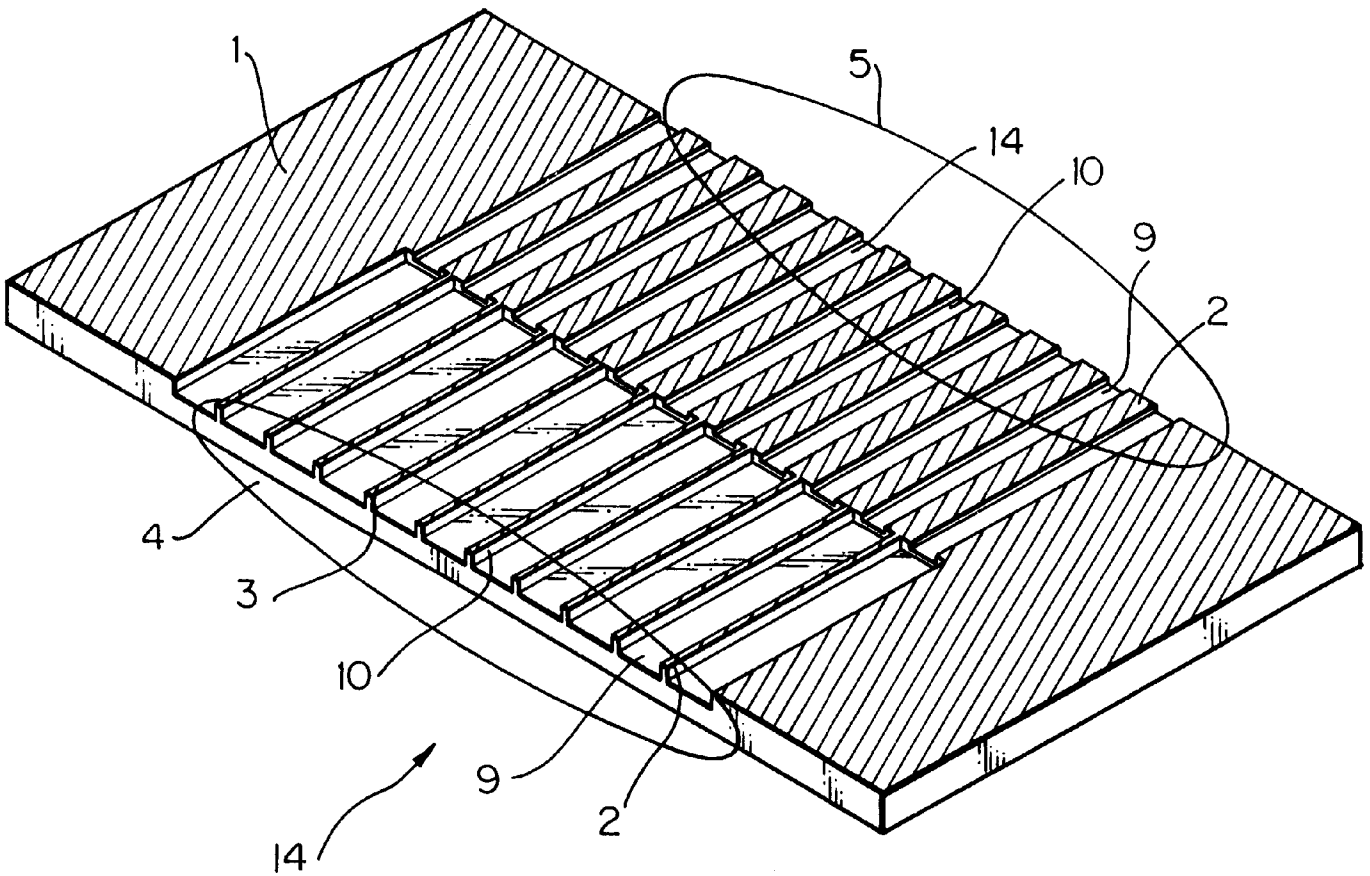
FIG. 5 is an enlarged view showing a substrate included in the embodiment of FIG. 3.

Referring to FIGS. 3, 4 and 5, a record head for an electrostatic ink jet recording apparatus and embodying the present invention will be described. As shown, the head includes a substrate 1 formed with ink passageways 9 and record electrodes 2. The substrate 1 is held between an upper cover 6 and a lower cover 7. An ink chamber 8 is formed in the space delimited by the upper cover 6 and lower cover 7. The ink passageways 9 are formed in the part of the substrate 1 lying in the ink chamber 8 by dicing, and each is communicated to a respective ejection port 4. The upper cover 6 is formed with an ink inlet 11 and an ink outlet 12. Ink is constantly circulated through the ink chamber 8 by being introduced into the chamber 8 via the ink inlet 11 and discharged via the ink outlet 12. Record electrodes 2 are extended to the end of the substrate 11 opposite to the end where the ejection ports 4 are located. The record electrodes 2 are led out at the above end of the substrate 11 and connected to outside circuitry by wire bonding or similar means. These connecting portions of the record electrodes 2 are designated by the reference numeral 5.

The substrate 1 is made from a glass, ceramic or silicon wafer. After a metal film has been formed on the surface of the substrate 1 by sputtering or similar technology, grooves 14 are formed in the above surface by dicing. The grooves 14 are arranged at a pitch implementing a desired resolution and serve as the ink passageways 9. The ridge between nearby grooves 14 forms a wall 10 separating the grooves 14. Thus, the metal film formed on the tops of the walls 10 which has been divided by dicing is allocated to the individual ejection ports 4. The divided portions of this metal film constitute the record electrodes 2. The ink passageways 9 are each communicated to the respective ejection port 4. The walls 10 each define a point (ejection point 3) for ejecting toner at the associated ejection port 4. The ink in each ink passageway 9 forms a meniscus between the ejection points 3 of the walls 10 delimiting the passageway 9.

In the illustrative embodiment, the grooves 14 are not simply straight. Specifically, the grooves 14 are deep and broad at the ejection ports 4, but shallow and narrow at the connecting portions 5 for the following reasons (1)–(4).

(1) The record electrodes 2 formed on the tops of the walls 10 must have their connecting portions 5 bonded or otherwise connected to outside circuitry. Therefore, the connecting portions 5 each needs a width of about 60 μm or above.

(2) The portions of the walls 10 lying in the ejection ports 4 form the ejection points 3. Each ejection point 3 should preferably be as narrow and sharp as possible and may advantageously have a width of 15 μm or less.

(3) The grooves 14, or ink passageways 9, should preferably be as deep as possible at the ejection ports 4.

(4) Because the portions of the grooves 14 on the connection portion side are not used as the ink passageways 9, they should preferably be as shallow and narrow as possible. This is effective to preserve the mechanical strength of the substrate 1 at the same time.

Assume that the portions of the ink passageways 9 adjoining the ejection ports 4 each has a width of W1 and a depth of H1, and that the portions of the passageways 9 adjoining the connecting portions 5 each has a width of W2 and a depth of H2. Then, the above conditions (1)–(4) will be satisfied if the width W1 is greater than the width W2 or if the depth H1 is greater than the depth H2.

Figure 6:
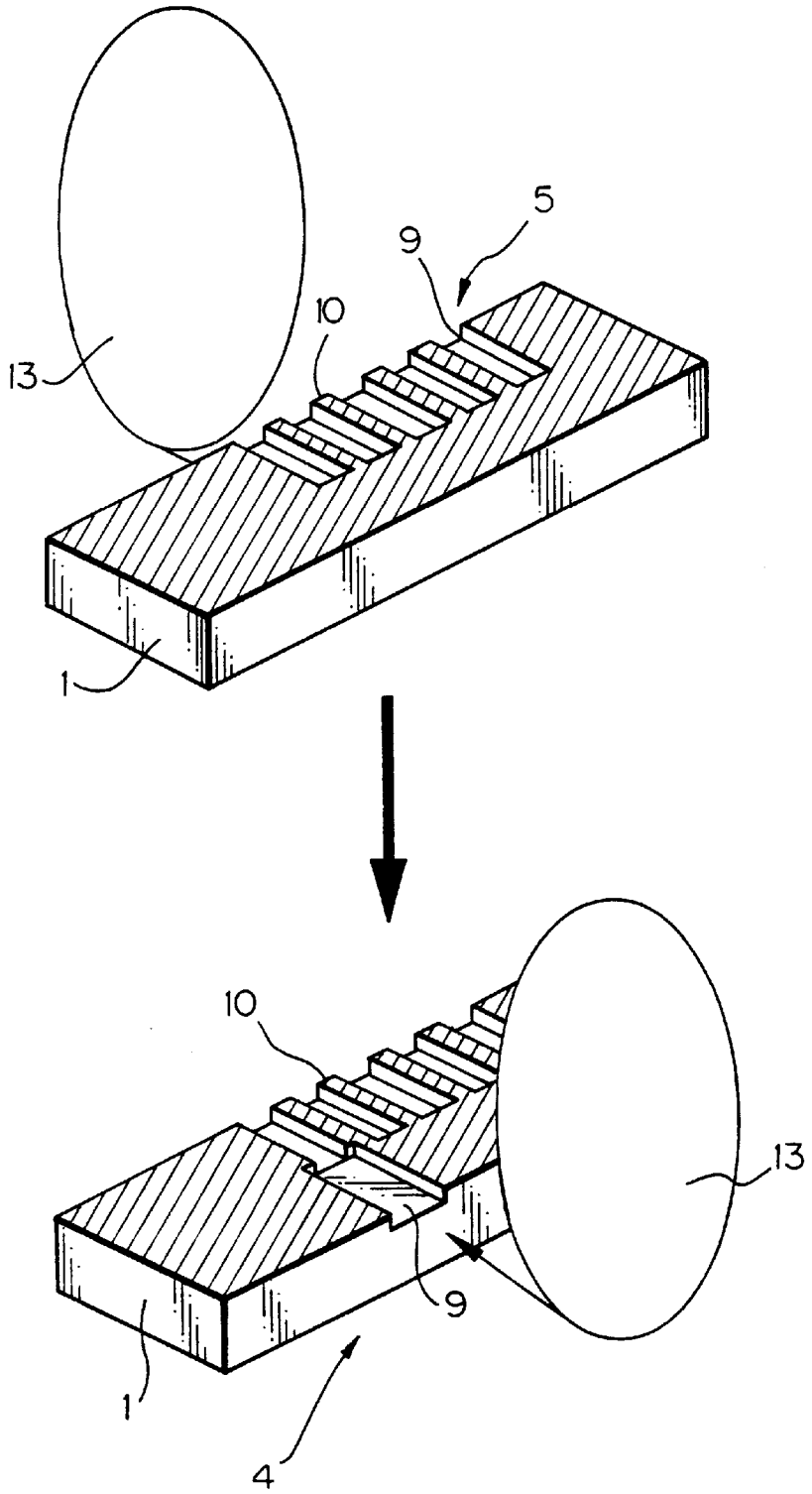
FIG. 6 demonstrates a procedure for dicing the substrate for inclusion in the embodiment of FIG. 3.

A procedure for forming the grooves 14 each having the above unique configuration by dicing will be described with reference to FIG. 6. Assume that a desired resolution is 300 dpi (dots per inch). Then, as shown in FIG. 6, a dicing blade 13 whose width is 25 μm or less cuts the substrate 1 to a depth of 50 μm or less from the end where the connecting portions 5 should be formed. The blade 13 ends cutting the substrate 1 about halfway across thereof. In this manner, the blade 13 forms the portions of the grooves 14 on the connecting portion side. Subsequently, the above blade 13 is replaced with another dicing blade 13 whose width is about 60 μm to 70 μm. This dicing blade 13 cuts the substrate 1 to a depth of about 10 μm to 200 μm from the other end such that the centers of the resulting grooves will align with the centers of the grooves formed previously. As a result, each ejection port 4 is provided with a narrow ejection point 3 and an ink passageway 9 having a great volume. On the other hand, each connecting portion 5 is provided with a broad area to be connected to outside circuitry; here, each groove separating nearby electrodes is shallow.

In summary, it will be seen that the present invention provides a record head for an electrostatic ink jet recording apparatus and a method of producing the same having the following unprecedented advantages.

(1) Ejection ports can be formed at a smaller pitch than conventional ejection ports, providing the record head with a higher resolution. This is because each groove is provided with an optimal width at each of its portions respectively adjoining the ejection port and a connecting portion.

(2) A substrate can be provided with great mechanical strength and can therefore be produced with high yield at low cost. This is because the portion of each groove on the connecting portion side is narrow and shallow although the other portion is deep.

Various modifications will become possible for those skilled in the art after receiving the teachings of the present disclosure without departing from the scope thereof.

What is claimed is:

1. A record head for an electrostatic ink jet recording apparatus for ejecting toner contained in an insulative solvent with an electrostatic force, comprising:

a substrate having a plurality of grooves formed therein so as to form a plurality of connecting portions along one side of said substrate and plurality of ejection ports along an opposite side of said substrate, said grooves each having at least a first width and a second width and at least a first depth and a second depth along their respective lengths, each width defined by a pair of parallel walls of substrate such that the pair of parallel walls defining the first width of each groove adjoins the pair of parallel walls defining the second width of the respective groove at a longitudinal end of the pair of parallel walls defining the first width and such that the pairs parallel walls defining the first widths of the plurality of grooves are parallel to each other and the pairs of parallel walls defining the second widths of the plurality of grooves are parallel to each other; and a plurality of record electrodes each formed on a corresponding wall of substrate by vapor deposition, wherein said record electrodes are physically and electrically separated from each other by said grooves.

2. A record head as claimed in claim 1, wherein said grooves each has a greater width at a portion thereof adjoining said ejection ports than at a portion adjoining said connecting portions opposite to said ejection ports.

3. A record head as claimed in claim 2, wherein a central longitudinal axis of said portion of each groove adjoining said ejection ports is axially aligned with a central longitudinal axis of said corresponding portion of said each groove adjoining said connection portions.

4. A record head as claimed in claim 2, wherein said grooves are spaced apart such that each of said connecting portions formed between said portions of said grooves having said greater width is at least 60 $\mu$m wide, and such that the portion of each of said walls in the ejection ports is at most 15 $\mu$m wide.

5. A record head as claimed in claim 1, wherein said grooves each has a greater depth at a portion thereof adjoining said ejection ports than at a portion adjoining said connecting portions opposite to said ejection ports.

6. A record head as claimed in claim 1, wherein each of said pairs of parallel walls formed in said substrate and defining said grooves is formed by at least two rotary cutting edges having mutually different widths.

7. A record head as claimed in claim 6, wherein said portion of each groove adjoining said ejection ports is defined by one of said pairs of parallel walls and has a first central longitudinal axis, and said corresponding portion of said each groove adjoining said connection portions is defined by another of said pairs of parallel walls and has a second central longitudinal axis, and wherein said first longitudinal axis is axially aligned with said second central longitudinal axis.

8. A record head as claimed in claim 6, wherein each of said grooves is defined by two pairs of parallel walls which are adjoined by a step at approximately halfway along the lengths of each of said grooves.

9. A record head as claimed in claim 8, wherein each of said grooves has two different depths, wherein said two different depths are adjoined by a step at approximately halfway along the length of each of said grooves so as to correspond with a position at which said two pairs of parallel walls are adjoined.

10. A record head as claimed in claim 1, wherein each of said grooves has a greater width and a greater depth at a portion thereof adjoining said ejection ports than at a portion adjoining said connecting portions opposite to said ejection ports.

11. A record head as claimed in claim 10, wherein each of said grooves has a width of at most about 25 $\mu$m and a depth of at most about 50 $\mu$m at said portion thereof adjoining said connecting portions, and a width of between about 60 $\mu$m and 70 $\mu$m and a depth of between about 10 $\mu$m and 200 $\mu$m at said portion thereof adjoining said ejection ports.

12. A record head as claimed in claim 11, wherein said grooves are spaced apart such that each of said connecting portions formed between said portions of said grooves having said greater width is at least 60 $\mu$m wide, and such that the portion of each of said walls in said ejection ports is at most 15 $\mu$m wide.

13. A method of producing a record head for an electrostatic ink jet recording apparatus for ejecting toner contained in an insulative solvent with an electrostatic force, said record head including a substrate having a plurality of grooves formed thereon so as to form a plurality of connecting portions along one side of said substrate and plurality of ejection ports along an opposite side of said substrate, said grooves each having at least a first width and a second width and at least a first depth and a second depth along the respective length thereof, such that a portion of each groove having the first width adjoins a portion of the respective groove having the second width at a longitudinal end of the portion having the first width, and such that the portions of the plurality of grooves having the first width are parallel to each other and the portions of the plurality of grooves having the second width are parallel to each other, said record head further including a plurality of record electrodes formed on each said wall by vapor deposition, wherein said record electrodes are physically and electrically separated from each other by said grooves, said method comprising the step of forming each of said grooves by cutting said substrate with at least two rotary cutting edges having mutually different widths to form said connecting portions and said ejection ports.

14. A method of producing a record head as claimed in claim 13, wherein said step of forming each of said grooves comprises:

using a first rotary cutting edge to cut a first portion of each groove from one side of said substrate to approximately halfway across said substrate, and using a second rotary cutting edge having a width different from that of said first rotary cutting edge to cut a second portion of each groove from an opposite side of said substrate to connect with said first portion of said each groove at approximately halfway across said substrate.

15. A method of producing a record head as claimed in claim 14, wherein said step of forming each of said grooves further comprises cutting said first portion of each groove with said first rotary cutting edge to have a different depth than said second portion of each groove cut by said second rotary cutting edge.

16. A method of producing a record head as claimed in claim 14, wherein said step of forming each of said grooves further comprises cutting said second portion of each groove so that a central longitudinal axis thereof is axially aligned with a central longitudinal axis of said first portion of said each groove.

17. A method of producing a record head as claimed in claim 13, wherein said step of forming each of said grooves comprises:

using a first rotary cutting edge to cut a first portion of each of said grooves from one side of said substrate to form said ejection ports; and using a second rotary cutting edge having a width greater than that of said first rotary cutting edge to cut a second portion of each of said grooves from an opposite side of said substrate to form said connecting portions.

18. A method of producing a record head as claimed in claim 13, wherein said step of forming each of said grooves comprises:

using a first rotary cutting edge to cut a first portion of each of said grooves from one side of said substrate to form said ejection ports; and using a second rotary cutting edge having a width different from that of said first rotary cutting edge to cut a second portion of each of said grooves from an opposite side of said substrate to form said connecting portions, such that said second portion of each of said grooves is cut to a depth greater than the depth of said first portion of each of said grooves.

19. A method of producing a record head as claimed in claim 13, wherein said step of forming each of said grooves comprises:

using a first rotary cutting edge to cut a first portion of each of said grooves from one side of said substrate to form said connecting portions; and using a second rotary cutting edge having a width greater than that of said first rotary cutting edge to cut a second portion of each of said grooves from an opposite side of said substrate to form said ejection ports, such that the width and depth of said second portion of each of said grooves is greater than the width and depth of said first portion of each of said grooves.

20. A method of producing a record head as claimed in claim 19, wherein said step of forming each of said grooves further comprises:

cutting said first portion of each of said grooves from one side of said substrate to approximately halfway across said substrate, and cutting said second portion of each of said grooves from said opposite side of said substrate to connect with said first portion of said each of said grooves at approximately halfway across said substrate.

* * * * *